US008087294B2

(12) United States Patent
Yoshie

(10) Patent No.: US 8,087,294 B2
(45) Date of Patent: Jan. 3, 2012

(54) DISCHARGE INSPECTION MECHANISM, RECORDING DEVICE, DISCHARGE INSPECTION METHOD, AND DISCHARGE INSPECTION PROGRAM

(75) Inventor: Shinichi Yoshie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 566 days.

(21) Appl. No.: 12/313,536

(22) Filed: Nov. 21, 2008

(65) Prior Publication Data

US 2009/0133503 A1 May 28, 2009

(30) Foreign Application Priority Data

Nov. 27, 2007 (JP) ..... 2007-305359

(51) Int. Cl.
*B41J 2/165* (2006.01)

(52) U.S. Cl. ..... 73/432.1; 73/865.9; 347/19; 347/23; 347/27

(58) Field of Classification Search ..... 73/662, 73/865.9, 432.1; 347/19, 23, 27, 47
See application file for complete search history.

(56) References Cited

U.S. PATENT DOCUMENTS

| | | | | |
|---|---|---|---|---|
| 5,731,826 | A * | 3/1998 | Hirano | 347/19 |
| 6,086,190 | A | 7/2000 | Schantz et al. | |
| 6,513,434 | B1 * | 2/2003 | Nakazawa et al. | 101/466 |
| 2004/0223027 | A1 * | 11/2004 | Shinkawa et al. | 347/23 |
| 2004/0227782 | A1 * | 11/2004 | Shinkawa et al. | 347/19 |

FOREIGN PATENT DOCUMENTS

| | | | |
|---|---|---|---|
| JP | 02239943 | A * | 9/1990 |
| JP | 08-336986 | | 12/1996 |
| JP | 11104535 | A * | 4/1999 |
| JP | 11-170569 | | 6/1999 |
| JP | 11170569 | A | 6/1999 |
| JP | 2002-166552 | | 6/2002 |
| JP | 2002166552 | A | 6/2002 |
| JP | 2007144720 | A | 6/2007 |

OTHER PUBLICATIONS

European Search Report, EP Applicaiton No. EP08019548, Mailed Nov. 13, 2009.

* cited by examiner

*Primary Examiner* — Hezron E Williams
*Assistant Examiner* — Rose M Miller
(74) *Attorney, Agent, or Firm* — Nutter McClennen & Fish LLP; John J. Penny, Jr.; Michael P. Visconti, III

(57) ABSTRACT

When vibrations that may adversely affect the results of inspecting recording fluid discharge occur during the discharge inspection, properly discharging nozzles may be determined to be not functioning normally or faulty nozzles may be determined to be functioning normally. A vibration sensor is therefore used to detect vibrations in the inspection box during discharge inspection of a plurality of nozzles. Whether vibration adversely affecting inspection results was detected during the discharge inspection is then verified after discharge inspection is completed, and the cleaning process is applied to the faulty nozzles that need cleaning if such vibration was not detected. If such vibration was detected, the cleaning process is not executed and discharge inspection is repeated.

10 Claims, 7 Drawing Sheets

DISCHARGE INSPECTION MECHANISM, RECORDING DEVICE, DISCHARGE INSPECTION METHOD, AND DISCHARGE INSPECTION PROGRAM

BACKGROUND OF THE INVENTION

1. Field of Invention

The present invention relates to a discharge inspection mechanism, a recording device, a discharge inspection method, and a discharge inspection program.

2. Description of Related Art

When an inkjet printer that prints images or other content on paper or other recording medium by discharging a recording fluid (referred to as simply "ink" below) from a plurality of nozzles disposed to a print head has some nozzles from which ink is not discharged properly, the content may not be properly printed. As a result, discharge inspection technologies that check whether ink is discharged reliably from the nozzles have been developed. The inkjet printer taught in Japanese Unexamined Patent Appl. Pub. JP-A-H11-170569, for example, detects if ink is discharged normally from a nozzle by detecting change in the field strength produced between electrodes by the charged ink droplets discharged from the nozzle. If the nozzles are not discharging normally, the nozzles are cleaned.

With the inkjet printer taught in Japanese Unexamined Patent Appl. Pub. JP-A-H11-170569, however, it is conceivable that the change in the field strength produced between electrodes by charged ink droplets discharged from the nozzle may not be correctly detected if the inkjet printer is subject to an external impact or vibration from shaking, for example, during the discharge inspection process. This may result in determining that properly discharging nozzles are not discharging correctly or conversely determining that nozzles that are not discharging are discharging correctly, and the discharge inspection thus returns an incorrect result. This can then result in cleaning nozzles that are functioning normally and do not need cleaning, or not cleaning nozzles that are not discharging and need cleaning.

SUMMARY OF THE INVENTION

The present invention solves at least part of the foregoing as described below.

A first aspect of the invention is a discharge inspection device that inspects discharge of recording fluid from a plurality of nozzles for discharging recording fluid, the discharge inspection device including a vibration detection unit that detects vibration information representing vibration of the discharge inspection device, a discharge inspection unit that applies the discharge inspection to the plural nozzles, and a control unit that controls the vibration detection unit and the discharge inspection unit. The control unit controls discharge inspection based on the vibration information detected by the vibration detection unit.

The vibration detection unit of this discharge inspection device detects vibration of the discharge inspection device. The control unit then controls whether the discharge inspection unit executes the discharge inspection process based on the detected vibration information. As a result, if the discharge inspection device is subject to vibration strong enough that recording fluid discharge cannot be correctly inspected, the control unit can apply control to repeat the discharge inspection or to not inspect recording fluid discharge. Problems caused by strong vibration of the discharge inspection device, such as determining that properly discharging nozzles are not functioning normally or that faulty nozzles are functioning normally, can thus be prevented. As a result, accurate results can be acquired from the discharge inspection process.

In a discharge inspection device according to a second aspect of the invention the vibration information is detected during the discharge inspection, and the control unit controls repeating the discharge inspection based on a value denoted by the detected vibration information.

The discharge inspection device according to this aspect of the invention can repeat the discharge inspection based on a value denoted by the vibration information detected while inspecting recording fluid discharge. The discharge inspection can therefore be repeated if vibration adversely affecting discharge inspection occurs while inspecting recording fluid discharge. As a result, accurate results can be acquired from the discharge inspection process.

In a discharge inspection device according to a third aspect of the invention the control unit controls stopping the discharge inspection in progress based on a value denoted by the vibration information detected during the discharge inspection.

The discharge inspection device according to this aspect of the invention can stop inspection of recording fluid discharge based on a value denoted by the vibration information detected during the discharge inspection. As a result, inspection can be stopped without completing inspection of discharge from all of the plural nozzles if vibration adversely affecting discharge inspection occurs while inspecting recording fluid discharge. The amount of time spent on discharge inspection can therefore be reduced and consumption of recording fluid can also be reduced when inspecting recording fluid discharge cannot be completed normally.

In a discharge inspection device according to a fourth aspect of the invention the vibration information is detected before executing the discharge inspection process, and the control unit controls not executing the discharge inspection process based on a value denoted by the detected vibration information.

In the discharge inspection device according to this aspect of the invention the discharge inspection process is not executed depending on the value denoted by the vibration information detected before discharge inspection. It is therefore possible to avoid the discharge inspection process if vibration that will adversely affect discharge inspection is detected before inspecting discharge starts. This aspect of the invention enables avoiding unnecessarily inspecting recording fluid discharge when recording fluid discharge cannot be executed correctly, and thus also reduces recording fluid consumption.

A discharge inspection device according to a fifth aspect of the invention also has a cleaning unit for applying a cleaning process to the plural nozzles, and the control unit controls executing the cleaning process according to the result of the discharge inspection.

The discharge inspection device according to this aspect of the invention can execute the cleaning process according to reliable discharge inspection results without being affected by strong vibration of the discharge inspection device.

In a discharge inspection device according to a sixth aspect of the invention the vibration detection unit has a sensor for detecting the vibration.

The discharge inspection device according to this aspect of the invention can detect vibration that will adversely affect the discharge inspection by means of the sensor.

In a discharge inspection device according to a seventh aspect of the invention the discharge inspection unit has a recording fluid receiving unit that receives the charged recording fluid discharged from the plurality of nozzles, and the sensor is disposed to the recording fluid receiving unit.

Using the sensor disposed to a recording fluid receiving unit for receiving charged recording fluid discharged from the plural nozzles, the discharge inspection device according to this aspect of the invention can directly detect vibration that will adversely affect inspecting recording fluid discharge, and can therefore obtain more reliable vibration information.

An eighth aspect of the invention is a recording device having the discharge inspection device described above.

With the recording device according to this aspect of the invention problems caused by strong vibration of the discharge inspection device in the recording device, such as determining that properly discharging nozzles are not functioning normally or that faulty nozzles are functioning normally, can thus be prevented. As a result, accurate results can be acquired from the discharge inspection process.

A recording device according to a ninth aspect of the invention has a sensor for detecting the vibration disposed to the recording device, and the vibration detection unit detects the vibration information using said sensor.

By disposing the sensor to the recording device, the recording device according to this aspect of the invention can detect vibration that will adversely affect the discharge inspection based on vibration in the recording device.

A tenth aspect of the invention is a discharge inspection method for inspecting discharge of recording fluid from a plurality of nozzles for discharging recording fluid, including a vibration detection step that detects vibration information representing vibration during the discharge inspection; a discharge inspection step that applies the discharge inspection to the plural nozzles; and a control step that controls the vibration detection step and the discharge inspection step. The control step controls executing the discharge inspection based on the vibration information detected by the vibration detection step.

In the discharge inspection method according to this aspect of the invention the vibration detection step detects vibration of the discharge inspection device. The control step then controls discharge inspection in the discharge inspection step based on the detected vibration information. As a result, if the discharge inspection device is subject to vibration strong enough that recording fluid discharge cannot be correctly inspected, the control step can apply control to repeat the discharge inspection or to not inspect recording fluid discharge. Problems caused by strong vibration of the discharge inspection device, such as determining that properly discharging nozzles are not functioning normally or that faulty nozzles are functioning normally, can thus be prevented. As a result, accurate results can be acquired from the discharge inspection process.

An eleventh aspect of the invention is a discharge inspection program that causes a computer to execute the steps of the discharge inspection method described above.

The discharge inspection program according to this aspect of the invention can be run under a predetermined operating system to execute the discharge inspection method described above and achieve the same effect as the discharge inspection method. This discharge inspection program can be recorded on a computer-readable recording medium for distribution and execution, and may also be received by a computer over the Internet or other communication medium.

Other objects and attainments together with a fuller understanding of the invention will become apparent and appreciated by referring to the following description and claims taken in conjunction with the accompanying drawings.

DESCRIPTION OF PREFERRED EMBODIMENTS

An inkjet printer having a discharge inspection device according to a first embodiment of the present invention is described below with reference to the accompanying figures.

General Configuration of an Inkjet Printer

The general configuration of an inkjet printer is described first below.

Figure 1:
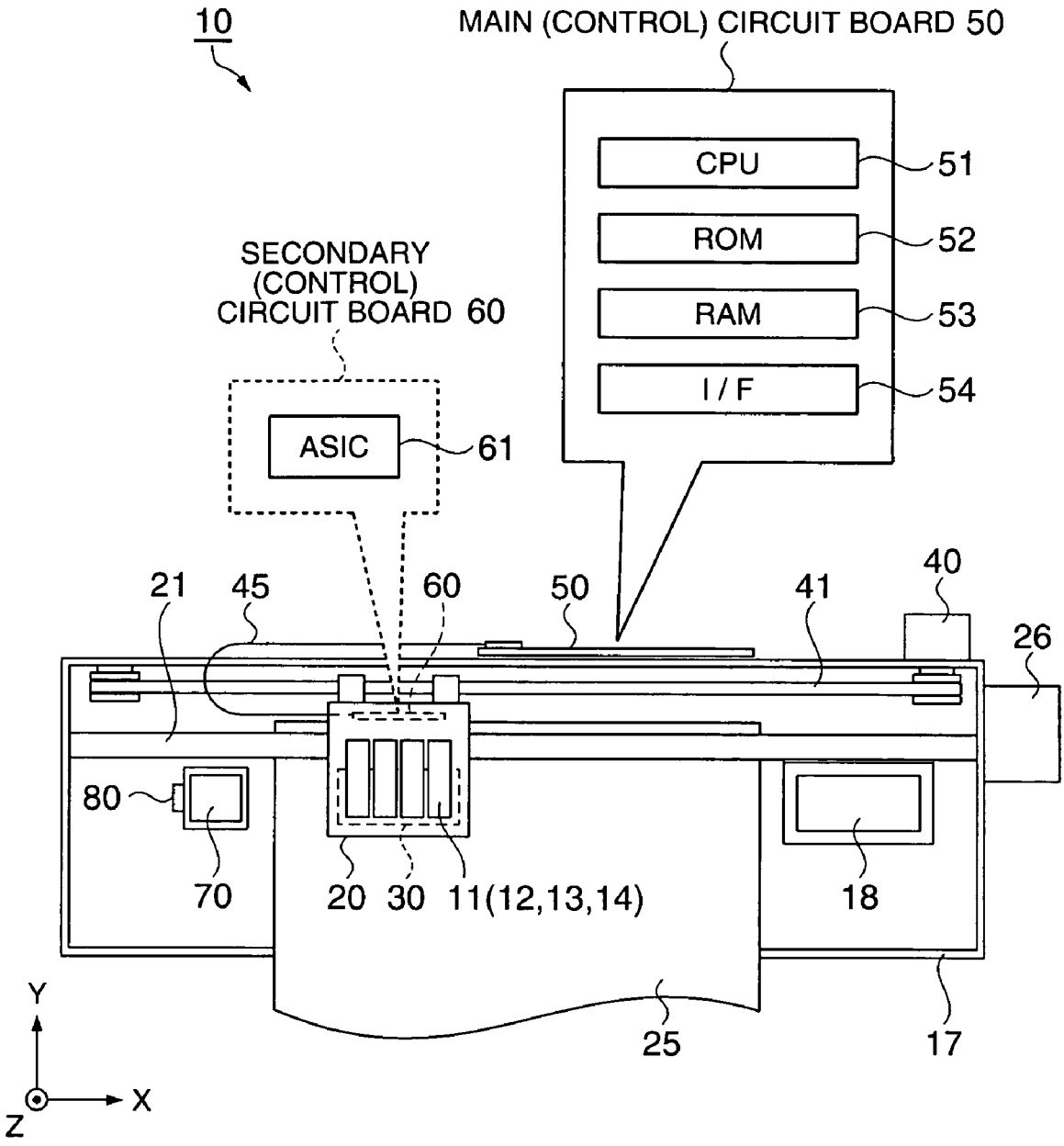
FIG. 1 is a schematic diagram of an inkjet printer having a discharge inspection device according to first embodiment of the invention.

FIG. 1 is a schematic diagram of an inkjet printer 1 having a discharge inspection device according to first embodiment of the invention. As shown in the figure the inkjet printer 10 has a carriage 20 on which ink cartridges 11 to 14 are installed. The ink cartridges 11 to 14 respectively store yellow (Y), magenta (M), cyan (C), and black (K) colored inks as the recording fluid. The carriage 20 travels in a main scanning direction (x-axis direction) and the print medium 25 travels in the subscanning direction (y-axis direction). As the carriage 20 and print medium 25 move in these directions, the inkjet printer 10 discharges ink droplets onto the print medium 25 in the z-axis direction from a print head 30 on the bottom of the carriage 20.

The carriage 20 is attached to a carriage belt 41 that is driven in a loop by a carriage motor 40. As the carriage belt 41 revolves, the carriage 20 moves in the main scanning direction along a guide 21 fixed to a frame 17. The print medium 25 also moves in the subscanning direction when transportation rollers not shown are driven by a drive motor 26 attached to the frame 17. As the carriage 20 and print medium 25 move, ink droplets are discharged from a plurality of nozzles disposed to the print head for discharging the different colors of ink, and a particular image or other content is printed on the print medium 25. If there are any nozzles from which the ink cannot be discharged, the image will not be correctly printed on the print medium 25.

At specific times, such as when the power is turned on, before a print job for printing something starts, during the print job, or when a print job ends, the inkjet printer 10 therefore executes a discharge inspection operation for determining whether or not ink droplets are discharged from each of the plural nozzles. This discharge inspection moves the carriage 20 to the position of an inspection box 70 that is disposed to the inkjet printer 10 as a recording fluid receiving unit, and detects if ink droplets are discharged from each of the nozzles. If this discharge inspection detects a faulty nozzle, that is, a nozzle from which ink droplets are not discharged, the carriage 20 is moved to the position of a cleaning box 18 provided in the inkjet printer 10 to clean the nozzles by means of a prescribed cleaning process.

A vibration sensor 80 is disposed to the inspection box 70. The vibration sensor 80 can detect vibration caused by impact or shaking externally applied to the inkjet printer 10.

The operation described above is controlled primarily by a main control circuit board 50 (referred to below as the main circuit board) disposed to the frame 17, and a secondary control circuit board 60 (referred to below as the secondary circuit board) disposed to the edge of the carriage 20. These circuit boards are connected to each other by a flexible circuit board 45 so that data can be exchanged between the boards.

The main circuit board 50 is populated with a CPU 51 for controlling operation of the inkjet printer 10, a ROM 52 storing a program related to these operations, RAM 53 for temporarily storing data required for these operations, and an interface 54 enabling data communication with the secondary circuit board 60 and data communication with a user computer or other external device. The discharge inspection program for inspecting ink discharge as described below is stored in the ROM 52.

An ASIC 61 containing the logic circuits and other devices for executing specific operations related to the discharge inspection is mounted on the secondary circuit board 60.

The CPU 51 reads the discharge inspection program stored in ROM 52 and exchanges signal data with the ASIC 61 so that the CPU 51 and ASIC 61 cooperatively execute the predetermined tasks of the discharge inspection operation.

Configuration of the Discharge Inspection Device

The configuration of the discharge inspection device is described next.

Figure 2:
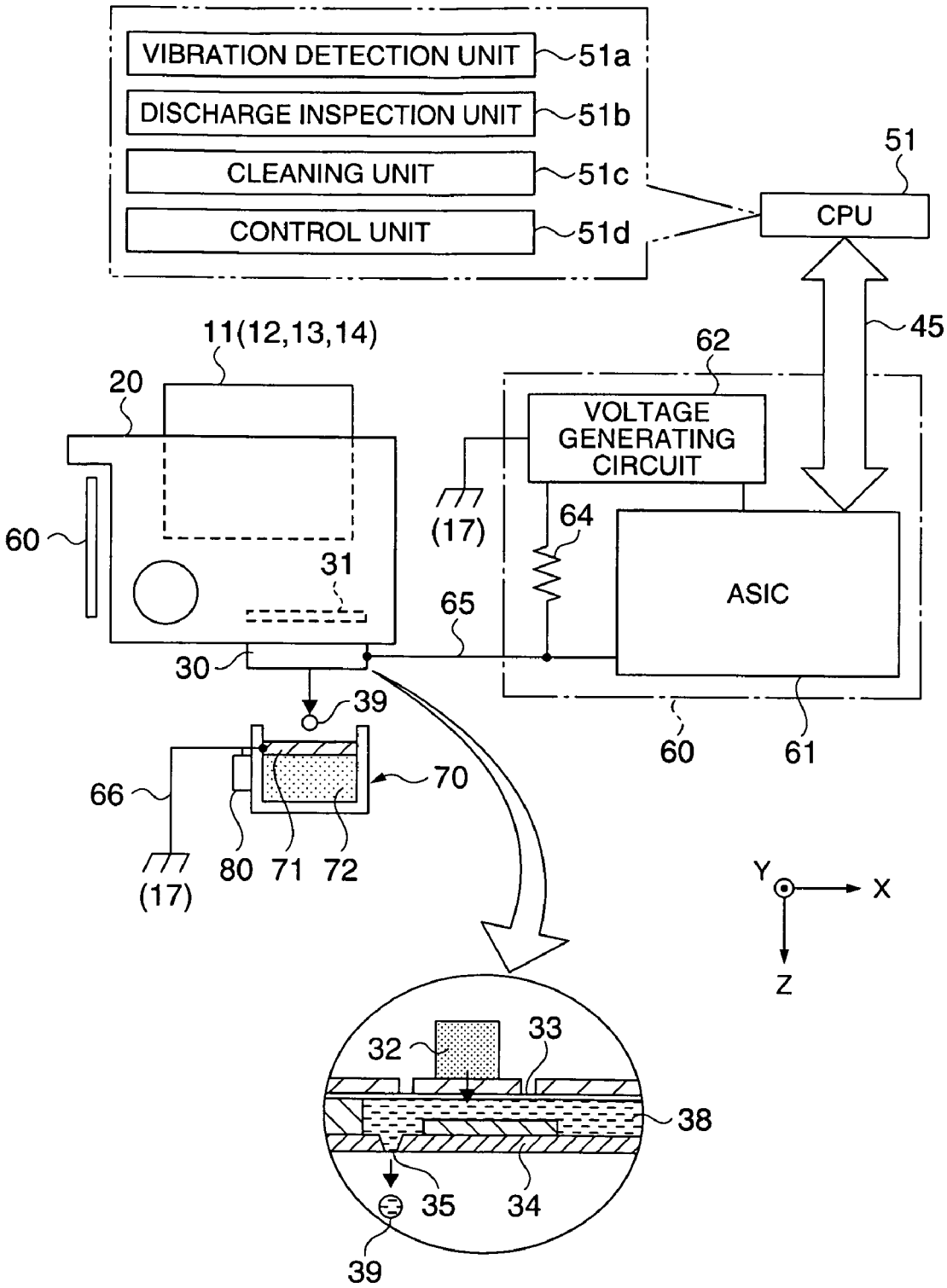
FIG. 2 schematically describes the discharge inspection device.

FIG. 2 schematically describes the configuration of the discharge inspection device. FIG. 2 shows the configuration of a device for discharging charged ink from the plural nozzles of the print head 30 and determining if ink is discharged from each of the nozzles.

When the carriage 20 moves to the predetermined position at the inspection box 70, ink supplied from the ink cartridges 11 to 14 to the print head 30 is discharged as ink droplets 39 from the print head 30 as shown in FIG. 2. A mechanism for producing ink discharge pressure in each of the plural nozzles of the print head 30 is rendered as shown in the enlarged drawing in FIG. 2. When voltage is applied to a piezoelectric device 32, the member 33 on which the piezoelectric device 32 is formed is pushed in the direction of the arrow (the z-axis direction). When the ink 38 supplied from the ink cartridge 11, for example, is pressurized, ink droplets 39 are discharged from an ink nozzle 35 disposed to the nozzle plate 34. More specifically, by applying voltage to the piezoelectric device 32 corresponding to the nozzle to be inspected, whether or not ink droplets 39 are discharged from that nozzle can be checked.

A voltage that causes the piezoelectric device 32 to deform (also referred to as the drive voltage below) is output from a driver circuit 31 as a drive signal applied to the piezoelectric device 32. The driver circuit 31 is disposed in the carriage 20 near the print head 30, is connected to the secondary circuit board 60 by a wiring member not shown, and operates according to an output signal from the ASIC 61.

The discharged ink droplets 39 land on an electrode member 71 disposed in the inspection box 70. The electrode member 71 is made from a stainless steel or other type of metal mesh rendering the ink droplet 39 landing area. The ink droplets 39 that land pass through the electrode member 71 and are absorbed by an ink absorber 72 such as a synthetic sponge. The electrode member 71 is electrically connected to the frame 17 by a wiring member 66.

A voltage generating circuit 62 is mounted on the secondary circuit board 60 on which the ASIC 61 is disposed. During the discharge inspection, the ASIC 61 causes the voltage generating circuit 62, one end of which is connected (grounded) to the frame 17, to operate. The ASIC 61 applies a predetermined voltage to the frame 17, and then applies a predetermined voltage to the print head 30 through a resistance 64 and wiring member 65. The part of the print head 30 to which the voltage is applied is a part (such as the nozzle plate 34) that is electrically conductive with the ink 38.

When the predetermined voltage is applied between the measurement pins of the print head 30 and electrode member 71 and an ink droplet is discharged from the nozzle, the voltage between the pins changes due to the scattering of the charged ink droplet. Whether an ink droplet was discharged or not can thus be detected by measuring the voltage between the measurement pins. The method of driving the nozzles for this discharge inspection is described in detail next.

As shown in FIG. 2, the CPU 51 functions as a vibration detection unit 51*a*, discharge inspection unit 51*b*, cleaning unit 51*c*, and control unit 51*d* by controlling the ROM 52, RAM 53, and ASIC 61.

The vibration detection unit 51*a* uses a vibration sensor 80 disposed in the inspection box 70 to detect vibration produced in the inspection box 70 by an external shock or shaking of the inkjet printer 10 as vibration information. The vibration detection unit 51*a* then outputs a vibration detection value denoting the detected vibration information as a signal indicative of the degree of a detected vibration.

In this embodiment of the invention the vibration sensor 80 is an acceleration sensor that detects acceleration caused by vibration of the inspection box 70, but the vibration sensor 80 is not limited to an acceleration sensor and may be rendered using a gyroscopic sensor, a pressure sensor, a photodetector, a proximity sensor, a mechanical contact sensor, or other device that can detect vibration. Note that if a mechanical contact sensor is used, it outputs a signal denoting that a predetermined threshold level has been exceeded only when it detects vibration that will adversely affect the discharge inspection.

The discharge inspection unit 51*b* inspects ink discharge from the plural nozzles of the print head 30, and determines whether or not ink droplets 39 are discharged from each of the nozzles. The discharge inspection unit 51*b* does this by driving the piezoelectric device 32 and measuring the voltage change between the print head 30 and electrode member 71. If this measurement detects a voltage change for the nozzle being inspected when the piezoelectric device 32 is driven, the discharge inspection unit 51*b* confirms ink droplet discharge, but if a voltage change is not detected, it determines that ink droplets were not discharged.

The cleaning unit 51*c* applies the cleaning process to the nozzles that need cleaning based on the result of the discharge inspection of each nozzle by the discharge inspection unit 51*b*.

The control unit 51*d* controls the overall operation of the inkjet printer 10, including the vibration detection unit 51*a*, discharge inspection unit 51*b*, and cleaning unit 51*c*. The control unit 51*d* controls whether or not the discharge inspection unit 51*b* executes the discharge inspection based on the vibration detection value output by the vibration detection unit 51*a*. The control unit 51*d* compares the detected vibration detection value with a predetermined threshold value to determine whether to execute the discharge inspection. This threshold value defines the vibration level that can be expected to adversely affect the discharge inspection, and is stored in ROM 52, for example.

Piezoelectric Device Drive Method

A method of driving the piezoelectric device that causes ink droplets to be discharged from the nozzle to be inspected is described next.

Figure 3:
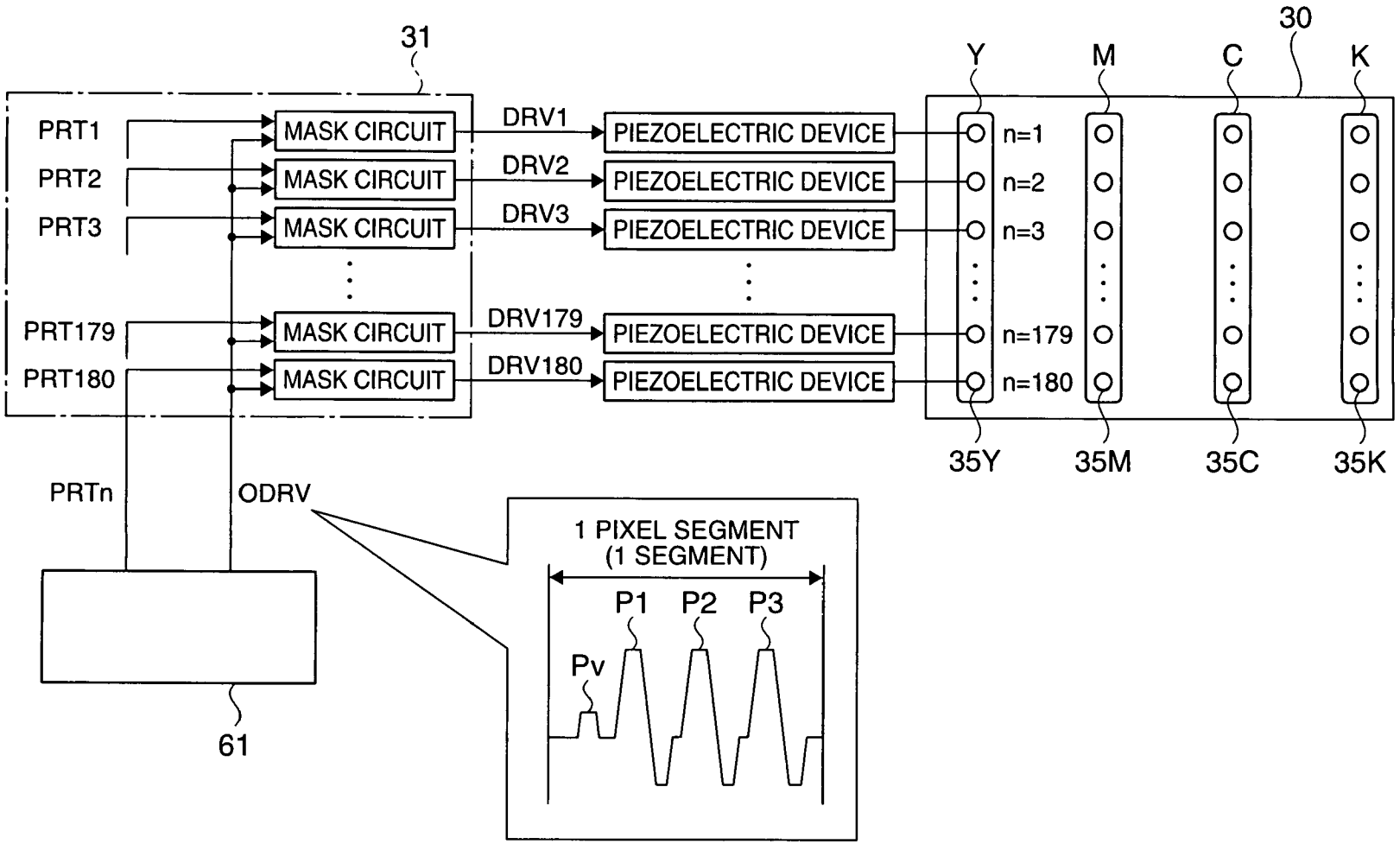
FIG. 3 describes the method of driving the piezoelectric device that discharges ink droplets.

FIG. 3 describes this method of driving the piezoelectric device that causes ink droplets to be discharged. In this embodiment of the invention as shown in the figure the print head 30 has nozzle rows 35Y, 35M, 35C, and 35K corresponding to ink colors yellow (Y), magenta (M), cyan (C), and black (K). In this embodiment of the invention the print head 30 has a total of 720 nozzles to be inspected. In order to discharge ink droplets from a particular nozzle to be inspected (referred to as the "inspection nozzle" below), drive signal DRVn (n=1-180) causing a particular piezoelectric device to deform is output from the driver circuit 31 to the piezoelectric device for the particular inspection nozzle in each of the Y, M, C, and K nozzle rows.

The main circuit board 50 produces a source signal ODRV and a print signal PRTn identifying the nozzle to discharge ink droplets. The source signal ODRV is a signal unit of four pulses Pv, P1, P2, P3 (the peaks in FIG. 3) that repeat in each segment printing an image equal to one pixel (the time required for the carriage 20 to cross an interval of one pixel is also called a segment).

Pulse signal Pv causes the ink to vibrate by causing the piezoelectric device to vibrate so that ink inside the nozzle does not solidify. Pulse signals P1, P2 and P3 cause one ink droplet to be discharged from the nozzle. Pulse signal P1 causes a small dot, pulse signal P2 causes a medium size dot, and pulse signal P3 causes a large dot to be formed on the print medium.

Print signal PRTn (n=1-180) causes the driver to output the drive signal DRVn for driving a particular piezoelectric device to the piezoelectric device corresponding to which of the 180 nozzles in each nozzle row Y, M, C, K is to discharge ink droplets. When printing, the print signal PRTn is the signal that selects the nozzle that discharges ink and the print data (whether a dot is printed or not and the gray level of the dot) based on the print image, and selectively supplies the drive signal for the selected nozzle. During discharge inspection, the print signal PRTn is the nozzle selection signal that selectively supplies the drive signal to the nozzle that is to discharge ink for inspection.

These signals are output through the ASIC 61 to a mask circuit disposed to the driver circuit 31. The mask circuit is configured so that the pulse signal selected from the source signal by the print signal PRTn is output to the piezoelectric device corresponding to the nozzle identified by the same print signal PRTn. In other words, the mask circuit is configured so that the pulse signal selected from among the pulse signals Pv, P1, P2, P3 by the print signal is output to the piezoelectric device corresponding to the selection inspection nozzle as the drive signal DRVn.

The discharge inspection process repeats a procedure outputting the drive signal DRVn generated by the mask circuit to the inspection nozzle selected by the nozzle selection signal for each of the 180 nozzles in one nozzle row. This process is then applied to all of the nozzle rows Y, M, C, and K so that the corresponding piezoelectric devices are sequentially driven and ink discharge is inspected for all of the nozzles in the print head.

Operation During Discharge Inspection

Operation during the discharge inspection process is described next.

Figure 4:
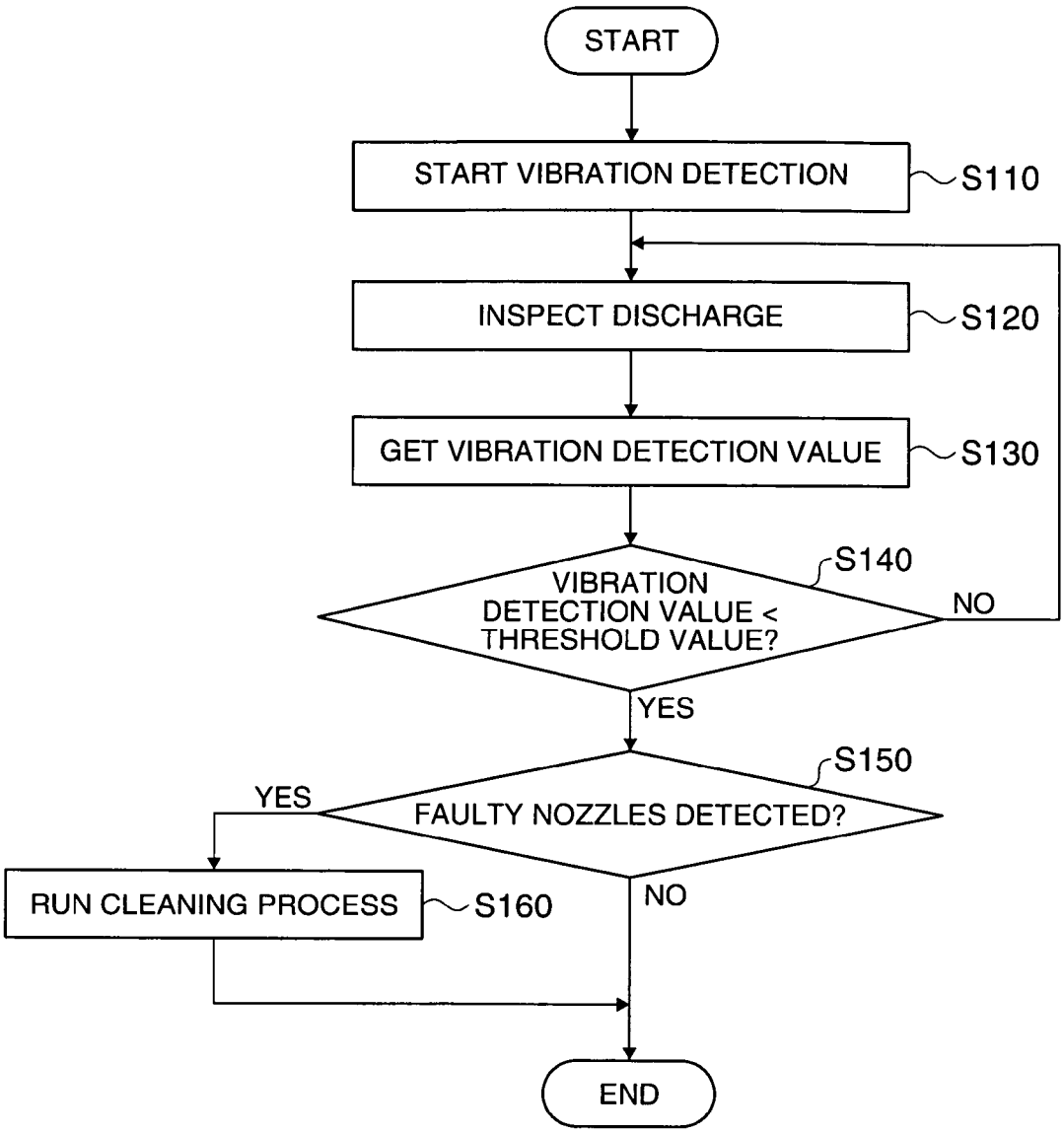
FIG. 4 is a flow chart describing the operation of the discharge inspection device according to a first embodiment of the invention.

FIG. 4 is a flow chart describing the operation of the discharge inspection device according to this first embodiment of the invention. The operation described in this flow chart is executed at the discharge inspection timing of the plural nozzles in the print head, such as when the power is turned on, before a print job starts, during the print job, and when a print job ends.

Operation starts with the vibration detection unit 51*a* of the CPU 51 starting detection of vibration in the inspection box 70 by means of the vibration sensor 80 in step S110. In step S120, the discharge inspection unit 51*b* of the CPU 51 applies the discharge inspection to the plural nozzles of the print head 30.

When the discharge inspection has been completed for all of the plural nozzles, the vibration detection value output by the vibration sensor 80 for the inspection box 70 is acquired by the control unit 51*d* of the CPU 51 in step S130. The vibration detection value acquired here represents the vibration produced in the inspection box 70 when ink discharge is inspected in step S120.

In step S140, the control unit 51*d* of the CPU 51 compares the vibration detection value acquired in step S130 with a predetermined threshold value. If the vibration detection value is less than the predetermined threshold value, the control unit 51*d* determines that vibration adversely affecting the discharge inspection was not applied to the inspection box 70 during the discharge inspection, and control goes to step S150. More specifically, if the discharge inspection was completed normally without being subject to vibration that could adversely affect the result of the discharge inspection, control goes to the process determining if there are any faulty nozzles that are not discharging correctly.

However, if the vibration detection value is greater than or equal to the predetermined threshold value, the control unit 51*d* determines that vibration adversely affecting the discharge inspection was applied to the inspection box 70 during the discharge inspection, and control returns to step S120. More specifically, if the discharge inspection was not completed without being subject to vibration that could adversely affect the result of the discharge inspection, the discharge inspection is repeated.

In step S150, the control unit 51*d* of the CPU 51 determines if there are any faulty nozzles that are not discharging correctly based on the result of the discharge inspection process executed in step S120. If there are no faulty nozzles, processing by the discharge inspection device ends.

However, if faulty nozzles are detected, control goes to step S160 and the cleaning unit 51*c* of the CPU 51 applies the cleaning process to the faulty nozzles determined to need cleaning, and processing by the discharge inspection device then ends.

Effect

When the discharge inspection is subject to vibration that could adversely affect the results in a device according to the related art, nozzles that discharge normally may be falsely determined to be faulty nozzles, and faulty nozzles that do not discharge normally may be falsely determined to be functioning normally. As a result, unnecessary cleaning operations may be executed or necessary cleaning operations may not be executed.

In the discharge inspection device according to the invention described above, however, vibration produced in the inspection box 70 is detected using a vibration sensor 80 during the discharge inspection of the plural nozzles in the print head 30. After the discharge inspection is completed, whether vibration adversely affecting the results of the discharge inspection was detected is verified. If such vibration was not detected, the presence of any faulty nozzles is detected, and the cleaning process is then applied if faulty nozzles are detected. However, if such vibration was detected, the cleaning process is not executed and the discharge inspection is repeated.

Because the cleaning process does not run when the discharge inspection is subject to vibration adversely affecting the result, executing the cleaning process based on incorrect discharge inspection results can be prevented. Furthermore, because the discharge inspection is repeated, the discharge inspection is ultimately completed under conditions not subject to the effects of vibration, and the correct discharge inspection result can be acquired.

Problems such as the correct image not be printed on the print medium 25 because of faulty nozzles not discharging correctly can therefore be prevented. In addition, problems such as unnecessary cleaning processes wasting ink in the ink cartridge, and making the user wait for cleaning processes that are not needed, can be prevented.

Embodiment 2

A discharge inspection device according to a second embodiment of the invention is described next.

Figure 5:
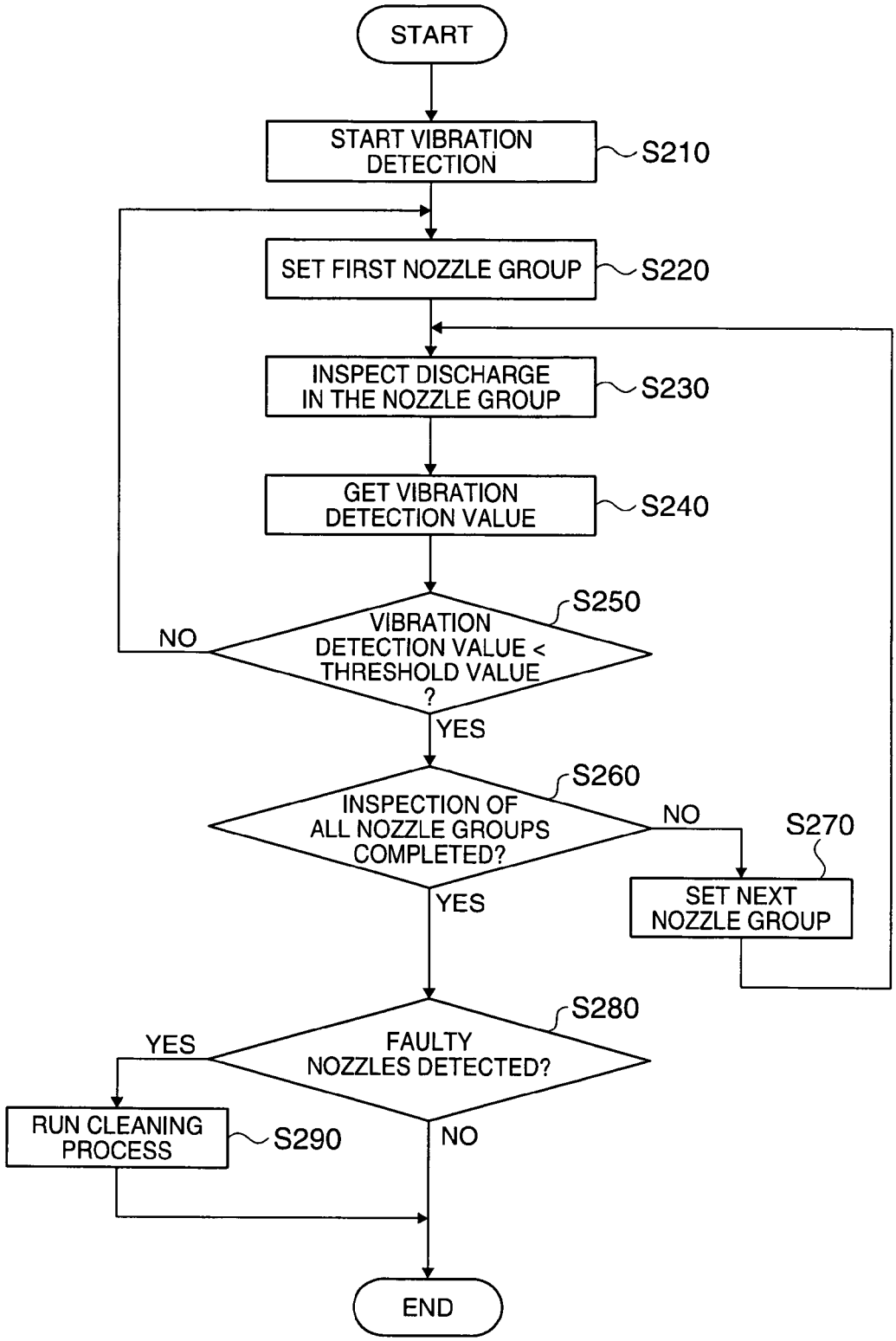
FIG. 5 is a flow chart describing the operation of the discharge inspection device according to a second embodiment of the invention.

The configuration of a discharge inspection device according to this second embodiment of the invention is the same as the configuration of the discharge inspection device according to the first embodiment of the invention shown in FIG. 2, but the operation of the discharge inspection device differs. FIG. 5 is a flow chart describing the operation of a discharge inspection device according to a second embodiment of the invention. The operation described in FIG. 5 starts at the same timing as the discharge inspection process described in the flow chart of the first embodiment shown in FIG. 4.

Operation starts with the vibration detection unit 51*a* of the CPU 51 starting detection of vibration in the inspection box 70 by means of the vibration sensor 80 in step S210. In step S220, the control unit 51*d* of the CPU 51 sets the first nozzle group of the print head 30 for inspecting ink discharge.

In this embodiment of the invention the nozzle groups of the print head 30 are the groups of nozzles in the nozzle rows 35Y, 35M, 35C, and 35K corresponding to ink colors yellow (Y), magenta (M), cyan (C), and black (K) as shown in FIG. 3. The nozzle group to which the discharge inspection is first applied is nozzle group 35Y in this embodiment. Note that the sequence in which the nozzle groups are inspected and the configuration of the nozzle groups of the print head 30 are not limited to the sequence and configuration described herein. For example, nozzle group 35K may be the first nozzle group that is inspected, and the configuration of the nozzle groups may be determined according to the number of ink colors or the number nozzles.

In step S230 the discharge inspection unit 51*b* of the CPU 51 applies the discharge inspection process to the nozzle group selected for inspection.

When discharge inspection of the selected nozzle group is completed, the control unit 51*d* of the CPU 51 acquires the vibration detection value detected by the vibration sensor 80 for the inspection box 70. The vibration detection value acquired here represents the vibration produced in the inspection box 70 when ink discharge is inspected in step S120.

In step S250, the control unit 51*d* of the CPU 51 compares the vibration detection value acquired in step S240 with a predetermined threshold value. If the vibration detection value is less than the predetermined threshold value, the control unit 51*d* determines that vibration adversely affecting the discharge inspection was not applied to the inspection box 70 during the discharge inspection, and control goes to step S260.

However, if the vibration detection value is greater than or equal to the predetermined threshold value, the control unit 51*d* determines that vibration adversely affecting the discharge inspection was applied to the inspection box 70 during the discharge inspection, and control returns to step S220. More specifically, if the discharge inspection was not completed without being subject to vibration that could adversely affect the result of the discharge inspection, inspecting ink discharge from the remaining nozzle groups of the print head 30 is stopped, and the discharge inspection process is applied again to the first nozzle group.

In step S260 the control unit 51*d* of the CPU 51 determines if discharge inspection has been completed for all nozzle groups of the print head 30. If discharge inspection of all nozzle groups is completed, control goes to step S280 to determine if there are any faulty nozzles that are not discharging correctly.

However, if there is a nozzle group for which discharge inspection has not been completed, control goes to step S270. In step S270 the control unit 51*d* of the CPU 51 sets the next nozzle group to be inspected. Control then returns to step S230 and the discharge inspection process is applied to the next nozzle group.

In step S280, the control unit 51*d* of the CPU 51 determines if there are any faulty nozzles that are not discharging correctly based on the result of the discharge inspection process applied to each of the nozzle groups in step S230. If there are no faulty nozzles, processing by the discharge inspection device ends.

However, if faulty nozzles are detected, control goes to step S290 and the cleaning unit 51*c* of the CPU 51 applies the cleaning process to the faulty nozzles determined to need cleaning, and processing by the discharge inspection device then ends.

Effect

The discharge inspection device according to this embodiment of the invention divides the nozzles of the print head 30 into a plurality of nozzle groups and applies the discharge inspection process to each nozzle group.

Whether vibration adversely affecting the results of the discharge inspection of each nozzle group was detected is then verified. If vibration adversely affecting the discharge inspection result was detected, discharge inspection of the remaining nozzle groups is stopped and the discharge inspection is repeated from the first nozzle group.

By thus stopping discharge inspection of the remaining nozzle groups when vibration adversely affecting the discharge inspection result is detected, it is not necessary to inspect ink discharge from all nozzle groups, and the time and recording fluid (ink) consumed by discharge inspection can be reduced.

Embodiment 3

A discharge inspection device according to a third embodiment of the invention is described next.

Figure 6:
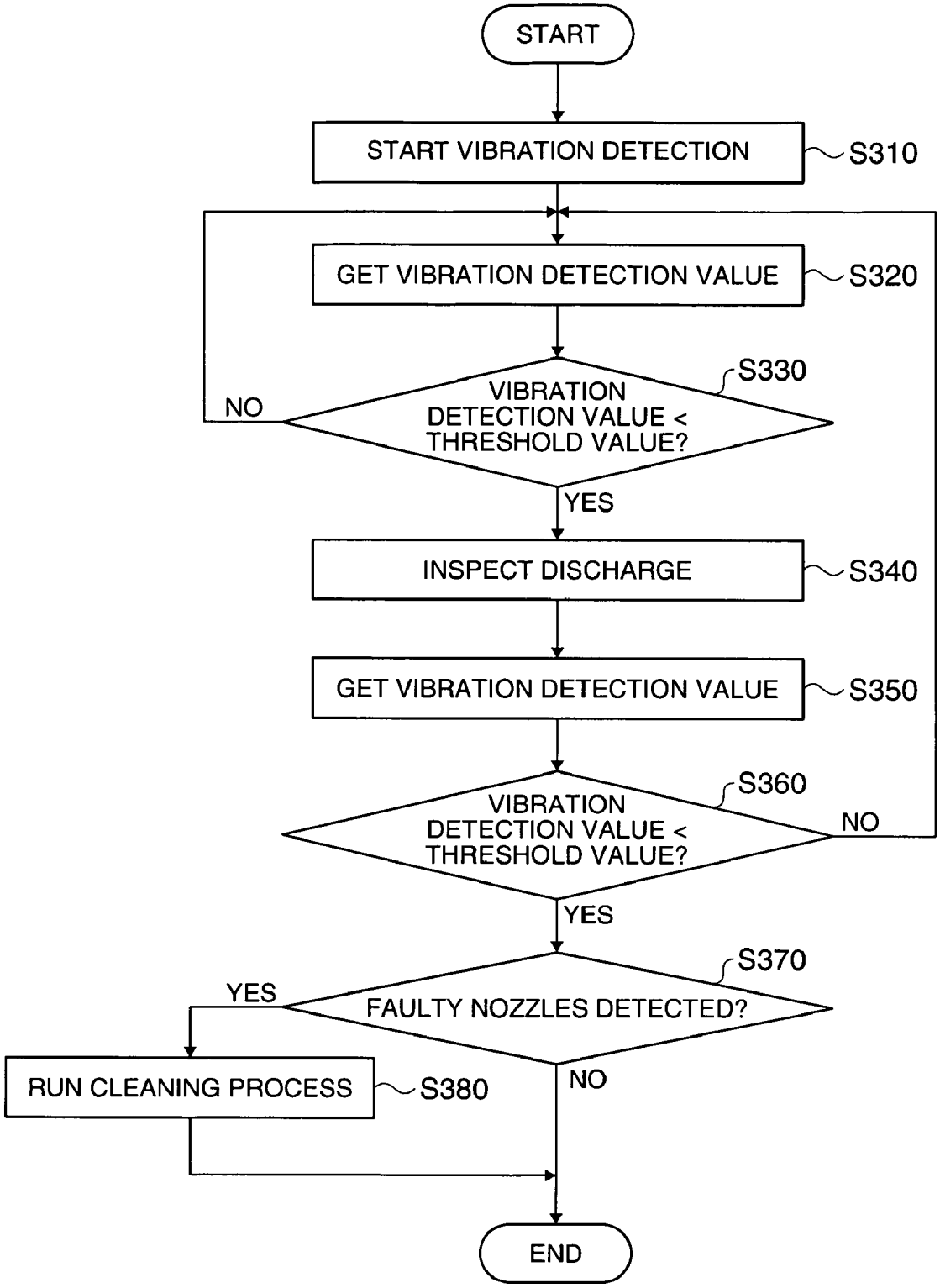
FIG. 6 is a flow chart describing the operation of the discharge inspection device according to a third embodiment of the invention.

The configuration of a discharge inspection device according to this third embodiment of the invention is the same as the configuration of the discharge inspection device according to the first embodiment of the invention shown in FIG. 2, but the operation of the discharge inspection device differs. FIG. 6 is a flow chart describing the operation of a discharge inspection device according to a third embodiment of the invention. The operation described in FIG. 6 starts at the same timing as the discharge inspection process described in the flow chart of the first embodiment shown in FIG. 4.

Operation starts with the vibration detection unit 51*a* of the CPU 51 starting detection of vibration in the inspection box 70 by means of the vibration sensor 80 in step S310. In step S320, the control unit 51*d* of the CPU 51 acquires the detected vibration detection value of the inspection box 70. Differing from the discharge inspection device of the first embodiment, the vibration detection value acquired here represents vibration detected in the inspection box 70 before the discharge inspection process.

In step S330 the control unit 51*d* of the CPU 51 compares the vibration detection value acquired in step S320 with a predetermined threshold value. If the vibration detection value is less than the predetermined threshold value, the control unit 51*d* determines that vibration adversely affecting the discharge inspection was not applied to the inspection box 70 before the discharge inspection, and control goes to step S340. More specifically, operation proceeds to the discharge inspection process only when there is no vibration adversely affecting the discharge inspection result.

If the vibration detection value is greater than or equal to the predetermined threshold value, the control unit 51*d* determines that vibration adversely affecting the discharge inspection was applied to the inspection box 70 before the discharge inspection, and control returns to step S320. More specifically, if there is vibration adversely affecting the discharge inspection result, this embodiment of the invention waits until such vibration is not detected.

In step S340 the discharge inspection unit 51*b* of the CPU 51 detects ink discharge from the plural nozzles of the print head 30.

When the discharge inspection has been completed for all of the plural nozzles, the vibration detection value output by the vibration sensor 80 for the inspection box 70 is acquired by the control unit 51*d* of the CPU 51 in step S350. As in the first embodiment, the vibration detection value acquired here represents the vibration produced in the inspection box 70 when ink discharge is inspected in step S340.

In step S360, the control unit 51*d* of the CPU 51 compares the vibration detection value acquired in step S350 with a predetermined threshold value. If the vibration detection value is less than the predetermined threshold value, the control unit 51*d* determines that vibration adversely affecting the discharge inspection was not applied to the inspection box 70 during the discharge inspection, and control goes to step S370. More specifically, if the discharge inspection was completed normally without being subject to vibration that could adversely affect the result of the discharge inspection, control goes to the process determining if there are any faulty nozzles that are not discharging correctly.

However, if the vibration detection value is greater than or equal to the predetermined threshold value, the control unit 51*d* determines that vibration adversely affecting the discharge inspection was applied to the inspection box 70 during the discharge inspection, and control returns to step S320. More specifically, if the discharge inspection was not completed without being subject to vibration that could adversely affect the result of the discharge inspection, the discharge inspection is repeated after the vibration stops.

In step S370, the control unit 51*d* of the CPU 51 determines if there are any faulty nozzles that are not discharging correctly based on the result of the discharge inspection process executed in step S340. If there are no faulty nozzles, processing by the discharge inspection device ends.

However, if faulty nozzles are detected, control goes to step S380 and the cleaning unit 51*c* of the CPU 51 applies the cleaning process to the faulty nozzles determined to need cleaning, and processing by the discharge inspection device then ends.

This embodiment of the invention describes applying the discharge inspection process to all nozzles of the print head 30 as a single group in the same way as described in the flow chart of the first embodiment shown in FIG. 4. The invention is not so limited, however, and the nozzles may be divided into nozzle groups and the ink discharge inspection may be applied by nozzle group as described in the flow chart of the second embodiment shown in FIG. 5.

Effect

The discharge inspection device according to this embodiment of the invention uses the vibration sensor 80 to detect vibration in the inspection box 70 before inspecting ink discharge from the plural nozzles of the print head 30. If vibration adversely affecting the discharge inspection result is detected, operation waits until the vibration stops.

As a result, when the inspection box 70 is subject to continuous vibration during the discharge inspection so that ink discharged cannot be correctly detected, the discharge inspection waits until it is not subject to such vibration. Consumption of the time and recording fluid (ink) required for discharge inspection can therefore be reduced.

Figure 7:
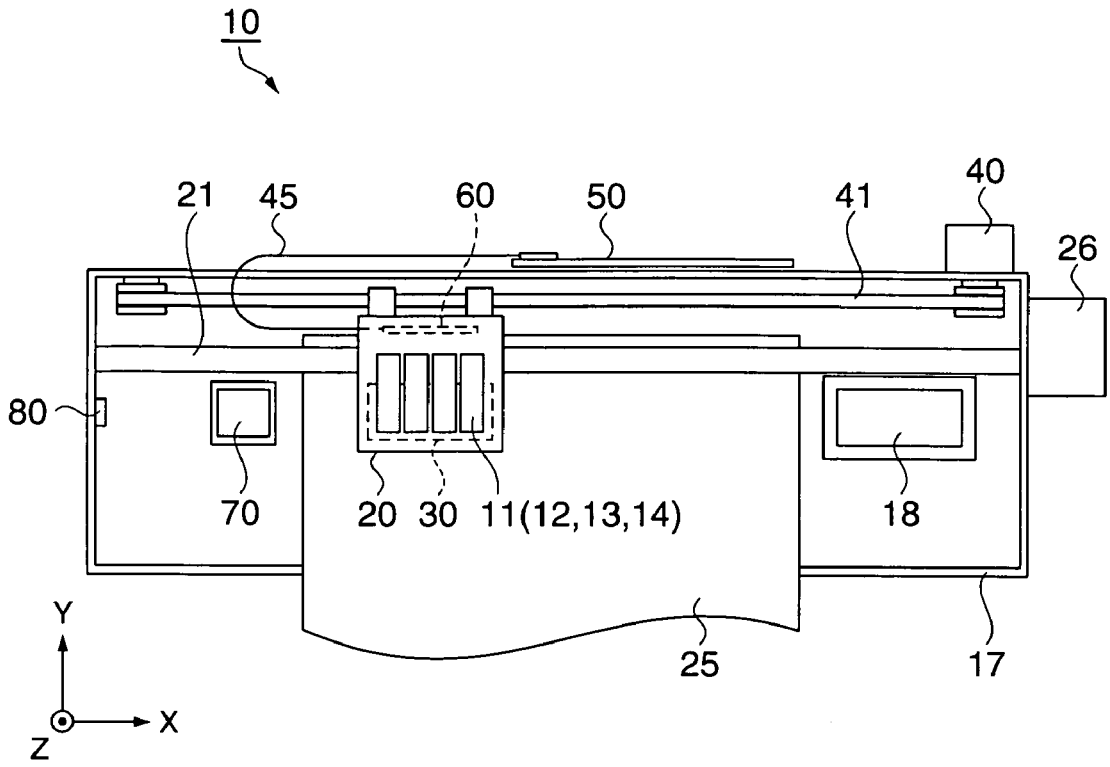
FIG. 7 shows an example of the vibration sensor mounted on the frame.

A vibration sensor 80 is disposed to the inspection box 70 of the inkjet printer 10 in the embodiments of the invention described above. The location where the vibration sensor 80 is disposed is not so limited, however, and the vibration sensor 80 can be located wherever vibration adversely affecting the discharge inspection result can be detected. FIG. 7 shows an example of a configuration in which the vibration sensor 80 is disposed to the frame 17 of the inkjet printer 10. By thus mounting the vibration sensor 80 on the frame 17, the effect of vibration produced by the drive units of the inkjet printer 10 can be reduced and vibration can be reliably detected.

The invention is described above using an inkjet printer having the discharge inspection device of the invention. The invention is not so limited, however, and the discharge inspection device described in the foregoing embodiments may be rendered in any type of device that records patterns, images, drawings, text, or other content on a recording medium by discharging recording fluid using an inkjet method. For example, the invention may be used in inkjet recording devices that discharge recording fluid to a glass substrate or resin substrate to form a wiring pattern, a color filter, or pixels on an organic electroluminescent display, for example.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A discharge inspection device that inspects discharge of recording fluid from a plurality of nozzles for discharging recording fluid, comprising:

a discharge inspection unit configured to perform a discharge inspection in which the discharge of recording fluid from the plurality of nozzles is inspected, the discharge inspection unit comprising:

an electrode member to which a predetermined voltage is applied, and on which a charged recording fluid discharged from the plurality of nozzles lands; and an inspection box in which the electrode member is disposed that receives the charged recording fluid;

a vibration detection unit disposed in the inspection box that detects vibration of the inspection box as detected vibration information;

and a control unit that controls the vibration detection unit and the discharge inspection unit;

wherein the control unit controls the discharge inspection based on the detected vibration information.

2. The discharge inspection device described in claim 1, wherein:

the detected vibration information is detected during the discharge inspection, and the control unit determines whether or not to repeat the discharge inspection based on detected vibration information.

3. The discharge inspection device described in claim 1, wherein:

the detected vibration information is detected during the discharge inspection, and the control unit determines whether or not to stop the discharge inspection in progress based on the detected vibration information.

4. The discharge inspection device described in claim 1, wherein:

the detected vibration information is detected before executing the discharge inspection, and the control unit determines whether or not to execute the discharge inspection based on the detected vibration information.

5. The discharge inspection device described in claim 1, further comprising:

a cleaning unit that is configured to perform a cleaning process in which the plurality of nozzles are cleaned;

wherein the control unit determines whether or not to perform the cleaning process based on a result of the discharge inspection.

6. The discharge inspection device described in claim 1, wherein the vibration detection unit includes a sensor for detecting vibration.

7. The discharge inspection device described in claim 6, wherein the discharge inspection unit has a recording fluid receiving member disposed in the inspection box that absorbs the charged recording fluid.

8. A recording device comprising:

a print head that has a plurality of nozzles and that discharges a charged recording fluid from the plurality of nozzles;

a discharge inspection unit configured to perform a discharge inspection in which discharge of the charged recording fluid from the plurality of nozzles is inspected, the discharge inspection unit comprising:

an electrode member to which a predetermined voltage is applied, and on which the charged recording fluid lands; and an inspection box in which the electrode member is disposed that receives the charged recording fluid;

a vibration detection unit disposed in the inspection box that detects vibration of the inspection box as detected vibration information; and a control unit that controls the vibration detection unit and the discharge inspection unit;

wherein the control unit controls the discharge inspection based on the detected vibration information.

9. A discharge inspection method for inspecting discharge of recording fluid from a plurality of nozzles for discharging recording fluid, comprising:

detecting vibration of an inspection box using a vibration detection unit disposed in the inspection box;

comparing a vibration detection value acquired by the vibration detection unit to a predetermined threshold value; and performing a discharge inspection to inspect the discharge of recording fluid from the plurality of nozzles if the vibration detection value is less than the predetermined threshold value, and not performing the discharge inspection if the vibration detection value is greater than or equal to the predetermined threshold value.

10. A non-transitory computer-readable storage medium having a discharge inspection program stored thereon, the program being configured to cause a computer to:

detect vibration of an inspection box using a vibration detection unit disposed in the inspection box;

compare a vibration detection value acquired by the vibration detection unit to a predetermined threshold value; and perform a discharge inspection to inspect discharge of recording fluid from a plurality of nozzles if the vibration detection value is less than the predetermined threshold value, and not performing the discharge inspection if the vibration detection value is greater than or equal to the predetermined threshold value.

* * * * *